US005682927A

United States Patent [19]

Takahashi et al.

[11] Patent Number: 5,682,927

[45] Date of Patent: Nov. 4, 1997

[54] TYING METHOD AND TYING APPARATUS FOR ARTICLES

[75] Inventors: Seiichi Takahashi, Tokyo; Youzou Kaneko, Soka; Tsutomu Saito, Tokyo, all of Japan

[73] Assignee: Bentac Co., Ltd., Tokyo, Japan

[21] Appl. No.: 592,304

[22] PCT Filed: Jun. 30, 1994

[86] PCT No.: PCT/JP94/01065

§ 371 Date: Feb. 9, 1996

§ 102(e) Date: Feb. 9, 1996

[87] PCT Pub. No.: WO95/05313

PCT Pub. Date: Feb. 23, 1995

[30] Foreign Application Priority Data

Aug. 16, 1993 [JP] Japan ..... 5-222325

[51] Int. Cl.[6] ..... B21F 15/04

[52] U.S. Cl. ..... 140/119; 140/52

[58] Field of Search ..... 140/57, 93 A, 140/118, 119

[56] References Cited

U.S. PATENT DOCUMENTS

| | | | |
|---|---|---|---|
| 3,368,590 | 2/1968 | Welden | 140/118 |
| 5,431,196 | 7/1995 | Forester, Jr. et al. | 140/119 |
| 5,505,504 | 4/1996 | Sato et al. | 140/119 |

FOREIGN PATENT DOCUMENTS

| | | |
|---|---|---|
| 2956/61 | 3/1963 | Australia . |
| B-34659/89 | 2/1990 | Australia . |
| 56-143339 | 10/1981 | Japan . |
| 64-9115 | 1/1989 | Japan . |
| 4-62851 | 5/1992 | Japan . |
| 6-115509 | 4/1994 | Japan . |

*Primary Examiner*—Lowell A. Larson

*Attorney, Agent, or Firm*—Armstrong, Westerman, Hattori, McLeland & Naughton

[57] ABSTRACT

A tying method and apparatus which is carried to easily automatically band bar-like articles such as reinforcements or pipes and various other articles by a linear tying material. The apparatus comprises tying material feed means (6), tying material bending means (8), encompassing and guiding means (9), tying material cutting means (7) and twisting means (11), wherein a starting point is formed in a way such that a part of a continuous linear tying material w delivered from the tying material feed means comes into engagement with the tying material bending means so that the tying material is bonded into a U-shape. In that state, the tying material is delivered from one side whereby the tying material is guided around an article to be tied by the encompassing and guiding means (9) while being bended into a substantially U-shape. The tying material is cut into a predetermined length, and both ends of the tying material are twisted together by a hook (25) of the twisting means (11). Since the tying material is automatically bended to form two strands and the tying is done only once thereby, the strength of the tying material is enhanced and the rigid tying can be made with a materially strong tying force. Further, since the twisting advances from the hook side toward the article to be tied, the twisting can be advanced till a looseness in the tying portion of the article to be tied disappears, thus enabling the strong tying.

23 Claims, 13 Drawing Sheets

Fig.8
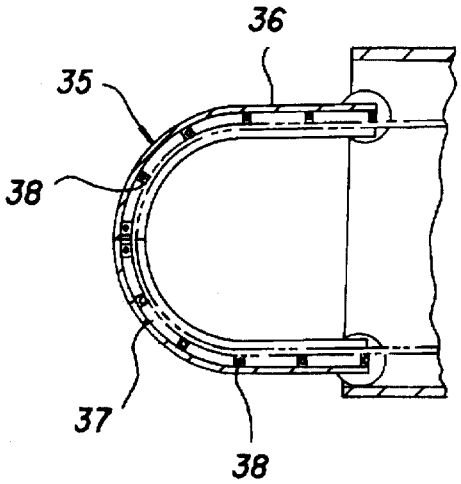
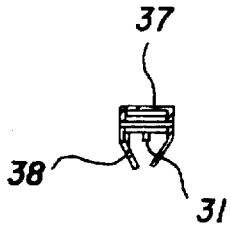
Fig.9(a)
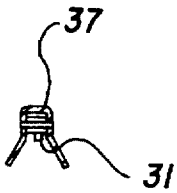
Fig.9(b)
Fig.10(a)
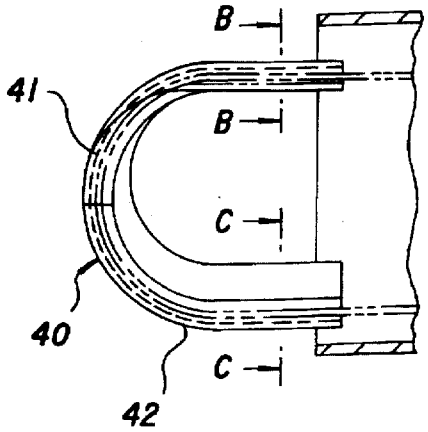
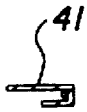
Fig.10(b)
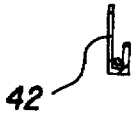
Fig.10(c)

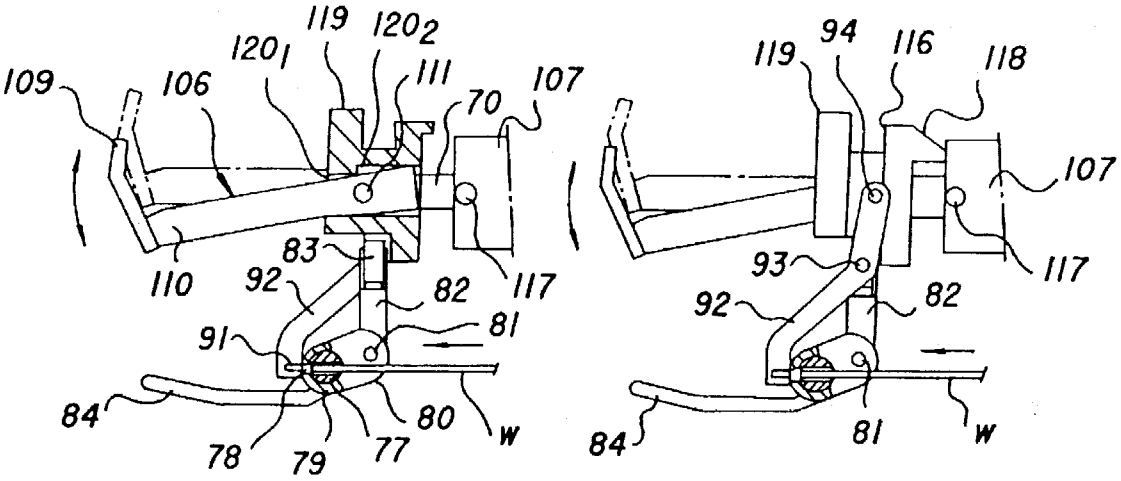
Fig. 12(b)
Fig. 12(a)
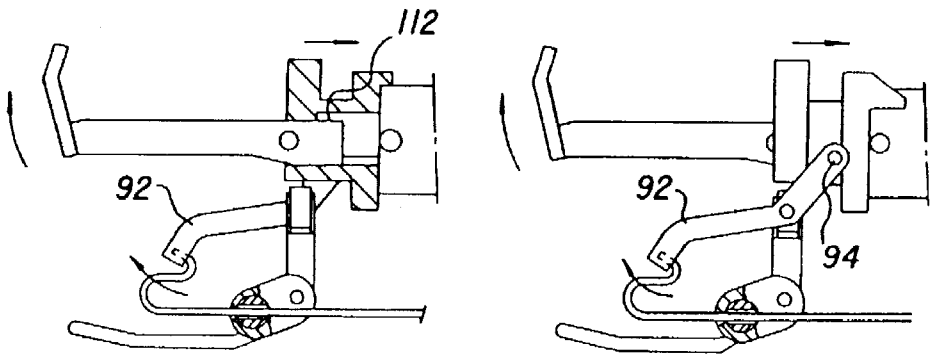
Fig. 12(d)
Fig. 12(c)

140
142
62
167
95
90
75
144
143
165
163
162
161
153
141
166
145
164
151
148
158
159
160
156
A
150
154
B
157
147
146
155

TYING METHOD AND TYING APPARATUS FOR ARTICLES

TECHNICAL FIELD

The present invention relates to a tying method and an apparatus therefor for automatically tying, by linear tying materials, bar-like articles such as reinforcements or heat insulating sheets, for pipes and ducts and various other articles.

BACKGROUND OF ART

In the past, in the operation for arrangement of reinforcements in the construction work, for example, the tying and securing of portions of reinforcements placed one above another have been carried out by manual operation. Generally, an iron wire used as a tying material is bent in advance into two parts so as to have a U-shape. The U-shape wire is extend over a portion of reinforcements placed one above another. A hook-like tool is hung on a bent portion of the iron wire and is then rotated several times, and opposite ends of the iron wire are twisted each other to bind the portions placed one above another.

For the tying in the above-described operation for arrangement of reinforcement, it is necessary to firmly grip and twist the opposite ends of the iron wire extended over the portions placed one above another. However, it is difficult to powerfully grip the iron wire due to the manual operation. Therefore, there existed an disadvantage that the iron wire tends to be loosened, failing to firmly bind the reinforcement. On the other hand, there is a problem in that when excessive twisting is earned out in order to provide a strong tying, an iron wire ruptures, lacking in reliability. Moreover, such an operation requires great skill and heavy labor, resulting in a poor operating efficiency. Thus, mechanization therefor has been demanded.

As a machine to meet the above-described demand, there has been proposed a tying machine capable of automatically tying reinforcements (for example, see Japanese Patent Laid-Open No.63(1988)-191719 Publication, etc.). However, tying machines heretofore proposed suffer from a problem in that any of these machines is very complicated in construction, is heavy and is expensive. Further, in any of these conventional machines, a single iron wire is drawn out of a bobbin and wound around a joined portion of reinforcements with that single iron wire to bind the joined portion, and therefore it is necessary to wind the object several times in order to provide a firm tying. This leads to a problem in that a quantity of consumed tying materials increases accordingly, resulting in a higher cost of wires to be used; in addition, the single wire tends to be ruptured; and a strong tying force is hard to obtain as compared with the tying through manual operation. The tying machine which fulfills the aforementioned demand has not yet been proposed.

Further, a motor for driving a tying mechanism such as feeding, twisting, etc. of automatic tying materials, in a portable automatic tying apparatus, it is necessary to employ such a motor as small as possible in order to make the tying machine small and light-weight. However, the tying mechanism is repeatedly rotated intermittently, normally and reversely. Therefore, in the case of a small motor, it becomes worn so early that the service life thereof ends after about 150,000 tyings. In the past, even if a motor becomes worn, the motor alone could not be replaced. For this reason, even if the tying mechanism portion is in a good condition, the tying machine itself cannot be used longer than the life of the motor, leading to a problem in terms of service life.

Accordingly, it is an object of the present invention to provide a tying method capable of tying articles such as reinforcements positively, automatically and in a short period of time with a strong tying force, and a tying apparatus in which the tying method can be achieved by a device which is simple in construction, small and light in weight.

It is a further object of the present invention to provide an automatic tying method and an apparatus therefor, which can firmly bind an article with a short tying material and can reduce consumption of tying materials.

It is a more specific object of the present invention to provide a tying method and an apparatus therefor in which a continuous linear tying material formed of steel or synthetic resin, etc. drawn out of a bobbin or the like molded of a pulp slurry or the like is automatically bent so that a single strand is formed into two tying strands, whereby an article can be tightly bound in a single roll.

It is another object of the present invention to provide an automatic tying apparatus in which a motor is of a cassette type such that a small motor is employed, and in a case where the motor becomes worn, this motor can be simply replaced by a new motor.

It is still another object of the present invention to provide a tying method and an apparatus therefor in which a tying apparatus body held by hands, from which body are disengaged a driving device, a bobbin or the like, is formed into a smaller and lighter type, whereby labor for tying operation can be further relieved.

DISCLOSURE OF THE INVENTION

The method of tying articles according to the present invention for achieving the aforementioned objects is characterized by comprising: encompassing and guiding a tying material around an article to be tied while bending a part of a continuous linear tying material into a substantially U-shape to form a pair of side-by-side strands of tying material; cutting a rear end portion of said tying material from a continuous wire at a suitable time; and twisting a substantially U-shaped extreme end portion and a rear end portion on the other side of said tying material together to band the article to be tied.

The term extreme end portion herein refers to an extreme end in a direction of feeding the tying material or a portion in the vicinity thereof, and the term "rear end portion" herein likewise refers to a rear end in a direction of feeding or a portion in the vicinity thereof. Further, the formation of two wires means that a single wire is formed into two wires, and does not necessarily mean that tying is done by a single wire but means that when two wires are supplied, these are formed into four wires so that tying can be done by a set of four wires.

According to the present invention, continuous linear tying material is drawn out and automatically bent into two strands, by which tying can be done. Therefore, as compared with the conventional tying method in which a single strand is wound, the strength of the tying material according to the present invention is enhanced and the tying can be firmly done with a materially strong tying force. Further, since twisting advances only in the direction of the article to be tied from the hook side, the twisting can be advanced to take up any clearances, thus providing a rigid tying. This method uses twisting, and the tying material need not be strongly held, thus providing good efficiency for the tying machine. Moreover the tying can be done with a short length, reducing consumption of the tying materials.

In the above-described encompassing and guiding step, the methods for forming two strands include four methods: a method in which a tying material is bent in an longitudinal direction, the outside of the bend is at least partly guided in an encompassing guide surface whereas while the inside thereof is moved with at least a part thereof directly contacting an article to be tied to form two strands; a method in which a tying material is bent in widthwise, and at least one side of the bend guided to said encompassing is guide surface to form strands; a method, which is an intermediary method between the aforementioned first and second method, in which a tying material is first bent in widthwise, and at least one side thereof is guided in said encompassing guide in surface and is bended longitudinally gradually from the midst, and the outside is at least partly guided in the encompassing guide surface whereas the inside is moved with at least a part thereof directly contacting the article to be tied to form two strands; and a method in which, conversely to the method previously mentioned, a tying material is first bent in longitudinally and then bended laterally gradually from the midst to form two wires.

The longitudinally and widthwise refer to longitudinally and widthwise. For example, in FIG. 1, the "longitudinally" is the up and down direction with respect to paper surface, while the "widthwise" is the vertical direction with respect to paper surface. The same is applied to the following.

After the aforementioned encompassing and guiding step, a hook of a twist shaft is brought into engagement with the substantially U-shaped extreme end portion of the tying material, and a tying material feed motor is reversely rotated to reversely pull the tying material to thereby bring the tying material into engagement with the periphery of the article to be tied so as to tension the tying material, whereby the tying material which was bent into a substatially U-shape and into the form of tow strands are moved closer to be a single strand so that the two strands come into contact with each other. Thereby rigid tying can be obtained, and the effective tying can be obtained with a short tying material.

Further, the rear end portion of the tying material can be moved closer toward the twist shaft whereby even if the hook is formed to be smaller, it can positively come in engagement with the rear end portion.

In the aforementioned twisting step, if the point at which the twist shaft engages the tying material is displaced so that at the start of engagement, said engaging point is at a position deviated from a diametrically central part of the rotational drive of the twist shaft and as the twisting advances, the engaging point substantially coincides with the diametrically central part of the rotational drive of the twist shaft, it is possible to advantageously prevent a repetitious stress from exerting on the tying material during the twisting.

The tying apparatus according to the present invention for achieving the above-described method is characterized by comprising: tying material feed mean for delivering a continuous linear tying material; tying material bending means in engagement with a part of the tying material to be delivered from said tying material feed means; encompassing and guiding means for guiding the tying material around an article to be tied while bending into a substantially U-shape the tying material a part of which is engaged in said tying material bending means and is delivered at least from one side; cutting means for cutting the tying material into a predetermined length; and twisting means for twisting both ends of the tying material together.

Since the aforementioned tying apparatus according to the present invention is simple in construction as compared with the conventional apparatus, it can be configured to be small and light weight. The apparatus can perform the tying operation automatically and positively by holding it by a hand to provide the readiness and high to provide efficiency of the tying operation. It is also possible to easily mount the apparatus on a robot. In addition, tying materials of short length can be used, and the tying materials can thus be used economically.

The aforementioned tying material bending means comprises a rotational member having an engaging portion with which a part of the tying material engages. This rotational member is journalled so that the rotational member is rotated when the extreme end portion of the tying material drawn out of the tying material feed means extreme end engages the engaging portion, or by an actuator. The rotational direction of the rotational member is as follows: When guiding the tying material while bending it substatially in a longitudinal direction, the rotational member rotates substantially in a longitudinal direction; and when guiding the tying material while bending it widthwise, the rotational member rotates substantially widthwise.

The aforementioned encompassing and guiding means comprises an opening and closing encompassing and guide rotatably journalled in the end portion of a body case, and a stationary guide. The encompassing and guiding means can be configured in a simpler manner by forming an engaging piece for an article to be tied on the opening and closing encompassing guide.

The aforementioned tying material twisting means is composed of a twist shaft oscillatably journalled in an end portion of a spindle rotationally driven by twisting drive means, and twist shaft oscillation control means for controlling the twist shaft from a stationary state for holding it so as to substantially coincide with a diametrically central part of the spindle and an oscillatable state within a range of a predetermined angle, to thereby advantageously enable the twisting substantially on the diametrical central part to prevent a repetitious bending stress from exerting on the tying material.

The aforementioned twist shaft oscillation control means can be composed of a cam body, having a through-hole, slidably externally fired over a connecting portion between the twist shaft and the spindle, said through-hole serving as an inner cam surface for controlling said twist shaft from a stationary state on a diametrally central part of the rotation and drive of the twist shaft, and to an oscillatable state within a range of a predetermined angle.

It is preferable that the spindle is made to be axially displaceable, and the twist shaft can thus be moved in a direction of an article to be tied as twisting advances.

The aforementioned tying material feed means, tying material bending means, tying material encompassing and guiding means, cutting means and twisting means are installed in a body case having a handle, and at least one of motors for rotationally driving the tying material feed means and the twisting means is received into a cassette type motor case detachably mounted on the motor case, whereby when the motor is damaged, it can be replaced simply.

The motor case in which at least one of the motors is received can be configured so as to also serve as a handle, whereby the tying apparatus body can be made smaller.

Moreover, the motor ease preferably has a body ease engaging portion in detachable engagement with the body case and a battery case engaging portion having a battery for driving the motor received on the opposite side, said battery capable of being detachably engaged with the battery case engaging portion.

The body case has a battery case engaging portion for detachably engaging the battery case directly or through a relay adapter on the end lengthwise opposite the encompassing and guiding means, said battery case having a trigger for driving the motor and capable of selectively engaging the motor case and the body case, thereby enabling the tying of an article to be tied which is present at a low position or at a high position easily.

A further tying apparatus according to the present invention comprises a tying apparatus body having a tying mechanism selection, and a drive and wire feed unit having a motor for driving the tying mechanism of said tying apparatus body and tying material feed means for supplying a tying material to the tying apparatus body, characterized in that a motor output shaft of said drive and wire feed unit and a drive shaft of the tying mechanism of said tying apparatus body are connected by a flexible shaft to transmit a driving force, and a continuous linear tying material is supplied from said drive and wire feed unit to said tying apparatus body for the automatic binding of an article.

According to the present invention, the tying apparatus body and the drive and feed unit are separately configured, whereby the tying apparatus body which is held by hands during operation can be made small and light weight as compared with prior art. The drive and wire-feed unit is worn on a belt and held on a waist or a shoulder, and only the tying apparatus body can be held by one hand to carry out the tying operation. Therefore, even child or woman can easily carry out the tying operation, thus enhancing the operating efficiency.

Preferably, the tying mechanism section of the tying machine body is composed of tying material bending means engaging and holding a part of a tying material being fed in a continuous linear form, encompassing and guiding means for guiding a tying material around an article to be tied while bending a part of the tying material, the tying material being fed from at least one side, into a substantially U-shape, with a pan of the length engaged by the tying material bending means, and twisting means for twisting both ends of the tying material together, whereby positive tying can be accomplished with a simple configuration. The drive and feed unit is provided with a main motor for driving the tying mechanism section, a tying material feed motor for driving the tying material feed means, a control circuit for controlling the tying material feed motor and the main motor, a battery case for receiving a power supply battery, and a bracket for supporting a wound bobbin for a tying material.

At least One of the main motor and the tying material feed motor is received into the motor case, which is detachably mounted on a unit case so that it can be replaced.

BRIEF DESCRIPTION OF THE DRAWINGS

FIG. 8 is a longitudinal sectional view of a guide of another embodiment of the tying apparatus according to the present invention; FIGS. 9(*a*) and 9(*b*) illustrate various modified examples in section of the encompassing guide;

FIGS. 10(*a*), 10(*b*) and 10(*c*) show encompassing guides in accordance with still another embodiment of the tying apparatus of the present invention, 10(*a*) being a side view, 10(*b*) being a sectional view taken on line B—B, 10(*c*) being a sectional view taken on line C—C;

BEST MODE FOR EMBODYING THE INVENTION

Figure 1:
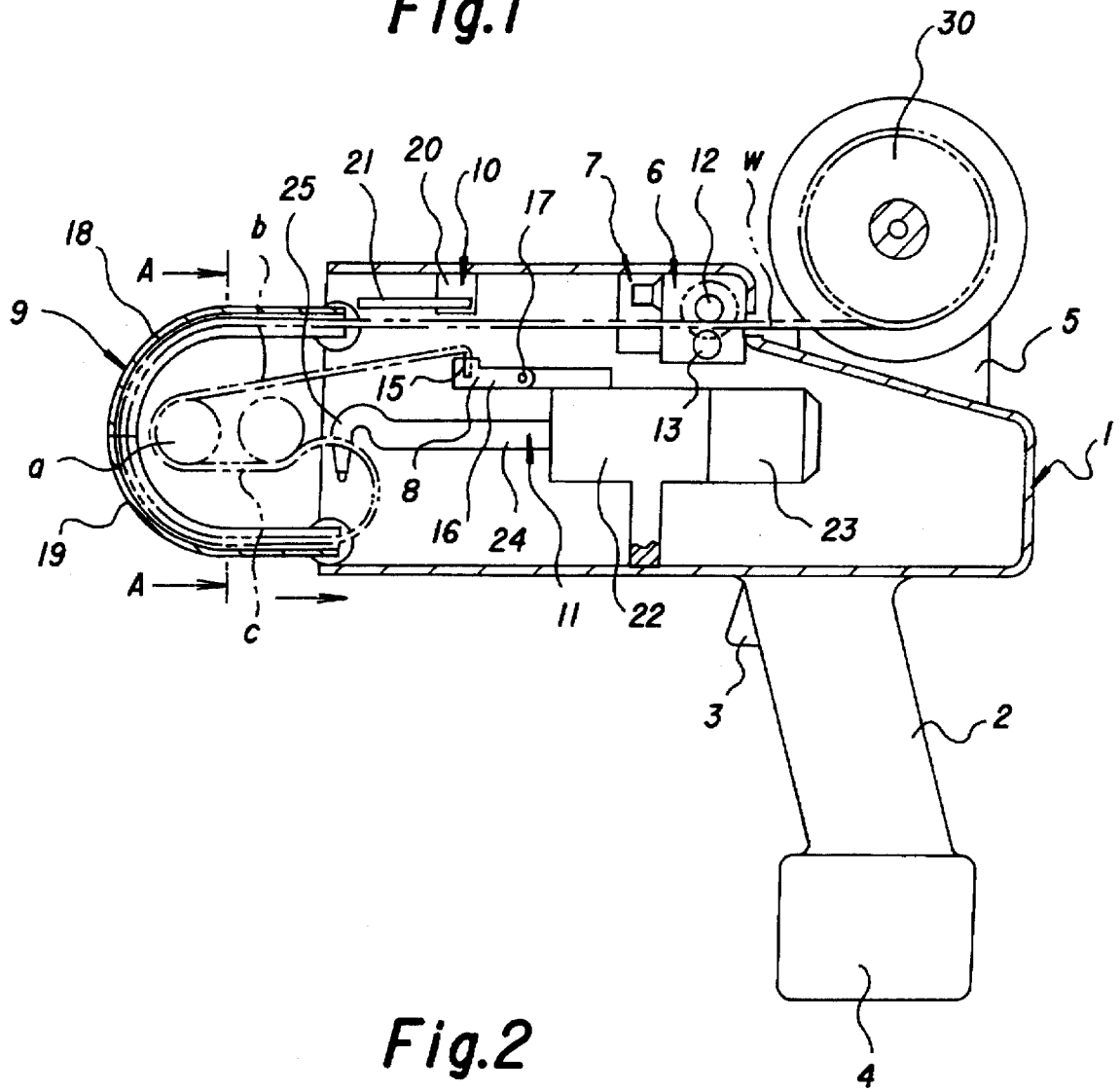
FIG. 1 is a schematic side view with a part of a case cutaway showing an embodiment of a tying apparatus according to the present invention.

The embodiments of the tying apparatus in accordance with the present invention will be described in detail hereinbelow with reference to the drawings.

FIGS. 1 to 5 show a tying apparatus in accordance with the present invention and an embodiment of a tying method according to the apparatus. In the tying apparatus according to the present embodiment, a body case 1 constituting a machine body has a pistol shape so that the body case 1 can be held by one hand to easily carry out the tying operation, and the tying can be automatically accomplished merely by operating a trigger switch 3 provided on a handle 2.

The tying apparatus according to the present embodiment mainly comprises a bobbin supporting portion 5 for rotatably supporting a wound bobbin B; tying material feed means 6 for drawing out a tying material w from the wound bobbin B to feed it out; cutting means 7 for cutting the tying material w into a predetermined length; tying material bending means in engagement with a part of the tying material fed out of the tying material feed means 6 to form the starting point at which the tying material is bent into a substantially U-shape; encompassing and guiding means 9 for guiding, while guiding the tying material in a curved fashion to form two strands having a substantially U-shaped extreme end portion at a head in a feeding direction, said two strands around an article to be tied; tying material-rear end portion moving means 10 for moving a rear end portion of the tying material into a rotational locus of twisting means; twisting means 11 for twisting both ends of the tying material together; and suitable drive means such as a motor for driving the tying material feed means, the tying material-rear end portion moving means and the twisting means.

The above-described various means ill be further described in detail hereinbelow.

The tying material feed means 6 is composed of a drive roller 12 rotationally driven by a motor (not shown) and a free roller 13 arranged opposedly of the drive roller 12. It is to be noted that the tying material feed means may take another form instead of the drive roller type as in this embodiment.

The cutting means 7 comprises a cutter which is provided downstream of the tying material feed means 6 and driven by an actuator such as an electromagnetic solenoid not shown or a cam operatively connected to a twist shaft, etc. Suitable cutters such as a sandwich type cutter, a cutter having a movable blade only on one side, etc. can be employed.

The tying material bending means 8 comprises a rotational member 16 having an engaging portion 15 such as a hole or a groove with which the end portion of the tying material engages, the rotational member 16 being journalled in a shaft 17 so that normally, the engaging portion 15 is positioned to face a moving path of the tying material fed out of the tying material feed means 6, and the end portion of the tying material is engaged therewith whereby the rotational member can be rotated with the aid of a feed force of the tying material. Further, in order that the engagement between the engaging portion and the tying material w may be released simply after the completion of feeding the tying material, in the present embodiment, the engaging portion is formed to be inclined widthwise and an inclined upper end thereof is made open and is held by a plate spring 14, as shown in FIG. 4(*a*). With this configuration, when the engaging end of the length of the tying material is pulled and thus moved along the inclined engaging portion 15,the plate spring 14 deforms as indicated by the broken line to allow the engaging end of the length to easily slip out of the engaging portion. The rotational member 16 is urged by a spring (not shown) so that when its engagement with the tying material w is released, the rotational member 16 is automatically returned to its normal position. While in the present embodiment, the rotational member 16 is supported on a twist shaft retaining frame 22 of the twisting means as shown, which will be described later, it is to be noted the rotational member 16 may be directly supported on the body case 1.

Figure 2:
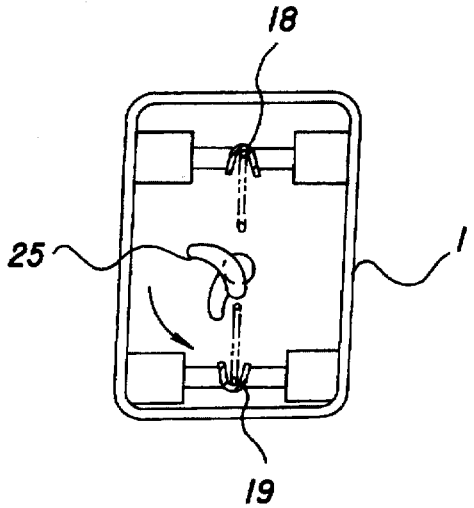
FIG. 2 is a view taken on line A—A of FIG. 1.
Figure 3A:
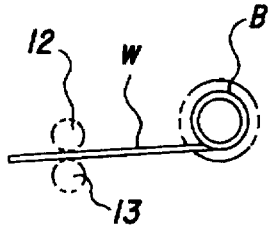
FIGS. 3(*a*) through 3(*g*) illustrate the steps of an embodiment of a tying method according to the present invention.
Figure 3B:
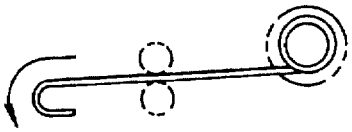
Figure 3C:
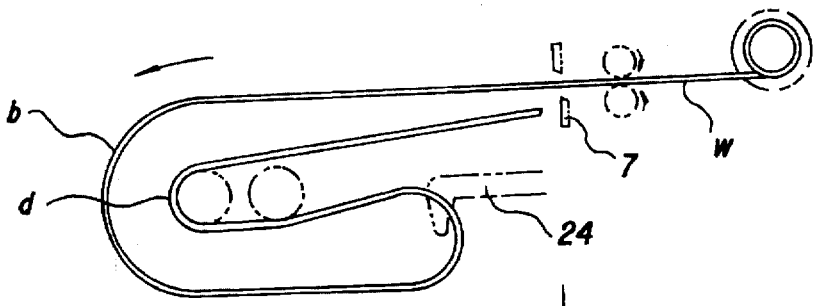
Figure 3D:
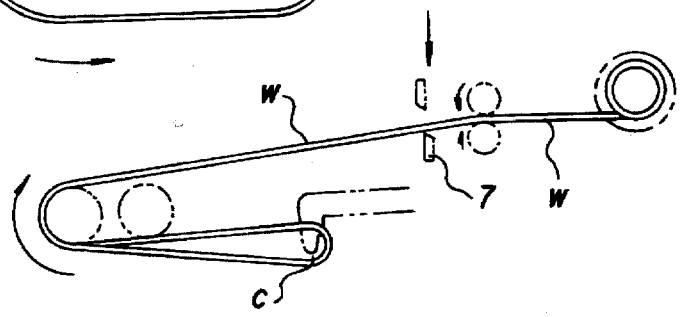
Figure 3E:
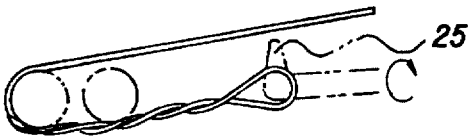
Figure 3F:
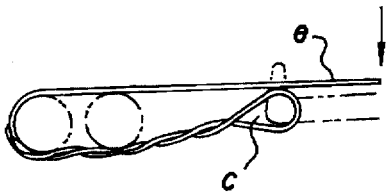
Figure 3G:
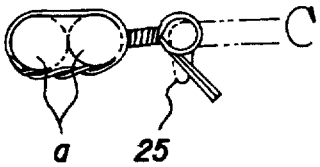
Figure 4A:
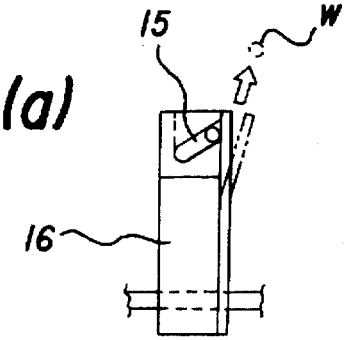
FIGS. 4(*a*), 4(*b*), 4(*c*), 4(*d*) and 4(*e*) show an embodiment of tying material bending means, 4(*a*) being a front view, 4(*b*) to 4(*e*) illustrating the operation as from the side.
Figure 4B:
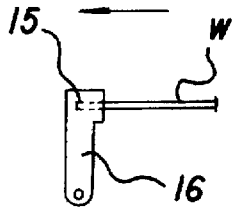
Figure 4C:
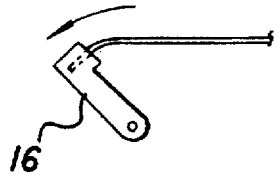
Figure 4D:
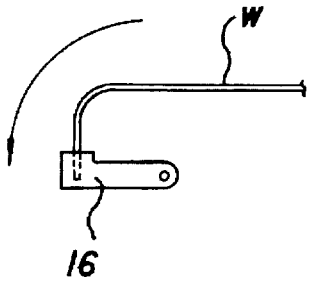
Figure 4E:
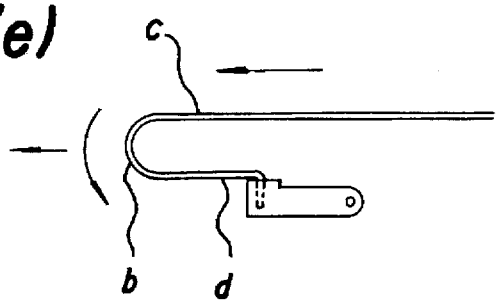
Figure 5A:
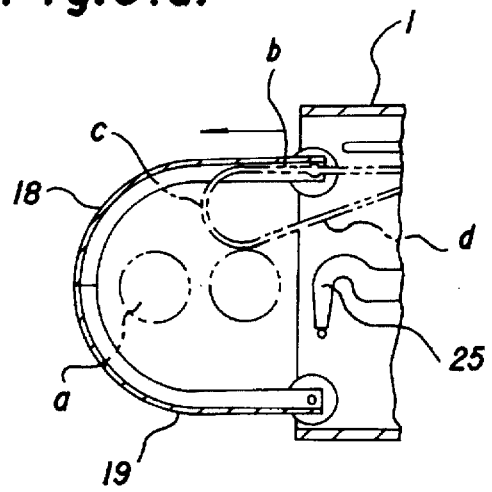
FIG. 5(*a*) through 5(*e*) illustrate the formation of two strands of tying material and the operation of a guiding mechanism.
Figure 5D:
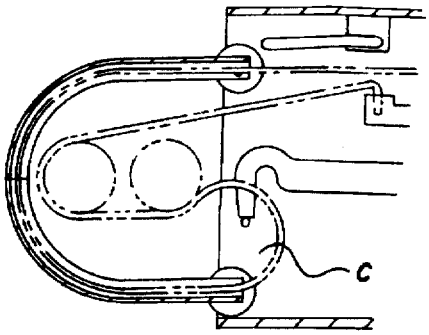
Figure 5B:
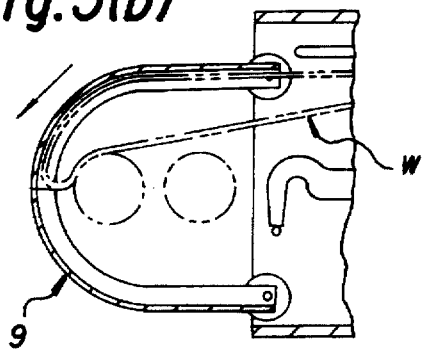
Figure 5E:
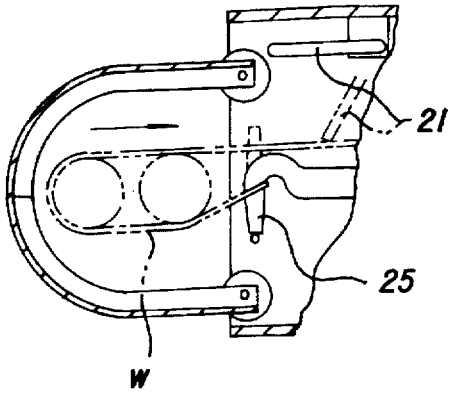
Figure 5C:
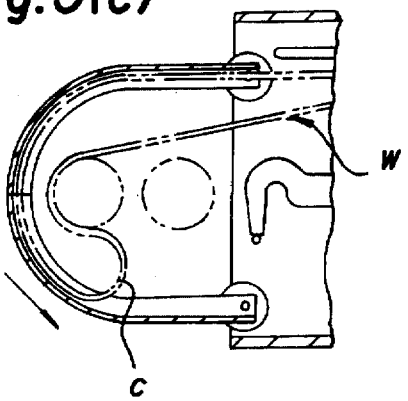
Figure 6A:
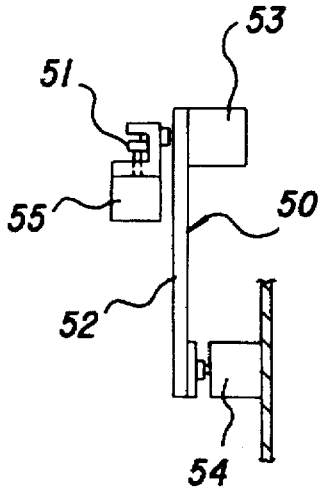
FIGS. 6(*a*), 6(*b*), 6(*c*), 6(*d*) and 6(*e*) show another embodiment of the tying material bending means, 6(*a*) being a front view, 6(*b*) to 6(*e*) illustrating the operation as viewed from the side.
Figure 6B:
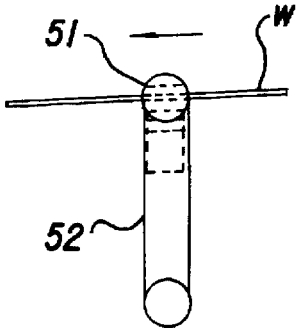
Figure 6C:
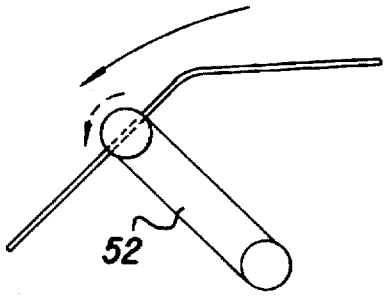
Figure 6D:
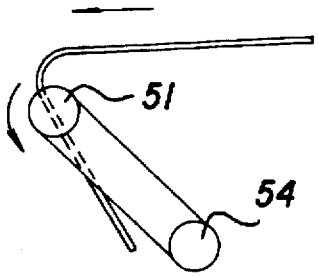
Figure 6E:
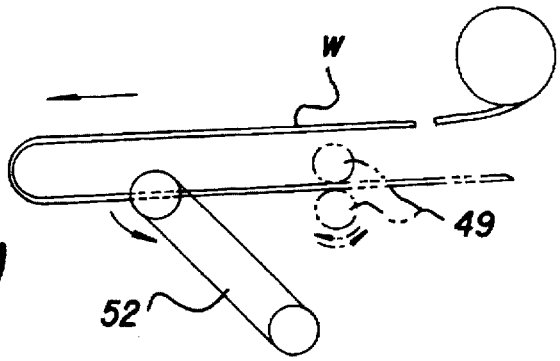
Figure 7A:
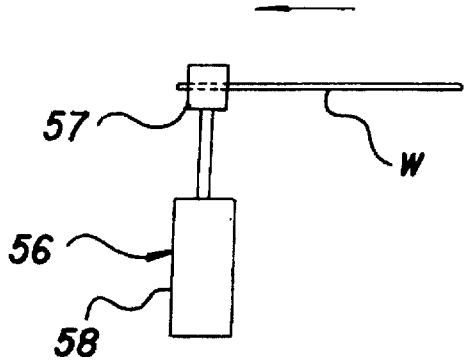
FIGS. 7(*a*) to 7(*d*) show still another embodiment of the tying material bending means, 7(*a*) to 7(*d*) illustrating the operation by way of a side view.
Figure 7B:
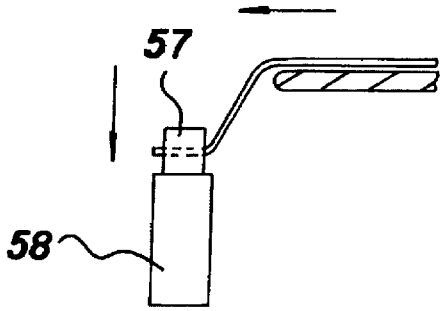
Figure 7C:
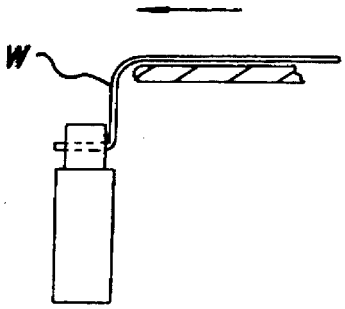
Figure 7D:
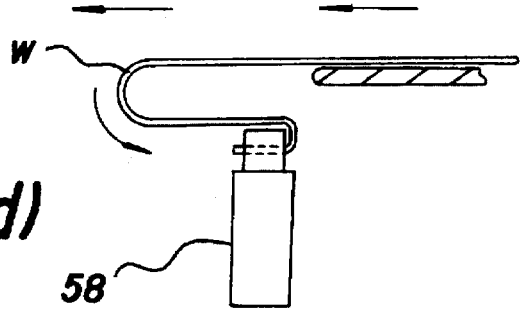

The encompassing and guiding means 9 is composed of a pair of encompassing guides 18 and 19 closeably journalled in the end portion of the body case 1. Both the encompassing guides in their closed state are continuous and in the form of a substantially semi-elliptical shape so as to locate an article to be tied (a) inwardly of a circular are. The encompassing guides 18 and 19 have a section in the shape of substatially U or V whose inside is open, as shown in FIG. 2, so that the external strand of the tying material being fed while being bent into the U-shape is moved along the guide surface of the bottom thereof, whereas the internal wire is positioned inwardly from the aforesaid guides and at least a part thereof comes into direct contact with the outer periphery of the article to be tied (a) whereby the wire is further guided.

Although not shown, since a load for feeding the tying material increases during the movement of the tying material being fed while being bent into a substantially U-shape from the starting end of the guide to the terminal end thereof, it is preferable that the depth of the guide be gradually deepened. The encompassing guides 18 and 19 may be configured such that they are closed by operating a button or a lever in an operating and holding portion, or by means of an automatic opening and closing mechanism making use of an actuator such as a solenoid, or a mechanical opening and closing mechanism such as a link mechanism, or by pressing the encompassing guides against the article to be tied. the encompassing guides may be of the double open type as in the present embodiment or of the type in which only the guide on one side can be opened and closed. In addition, only a stationary guide having a cut through which an article to be tied can pass, may be employed.

The tying material-rear end portion moving means 10 is provided to move the rear end portion of the tying material, which is guided around the article to be tied (a) in the state of two strands by the encompassing guides, to a twisting position. In the present embodiment, a moving lever 21 is rotated up and down in FIG. 1 by means of a rotary solenoid 20.

The tying material twisting means 11 has a twist shaft 24 which is supported on a twist shaft supporting frame 22 in a substantially central portion within the case and rotatably driven by a motor 23 through a reduction gear, the twist shaft 24 having a hook 25 formed at the end thereof, the hook 25 engaging a bent head portion of the tying material.

A microcomputer for controlling; a motor for driving the drive roller 12 of the tying material feed means 6, an actuator for driving the cutting means, an actuator for driving the tying material-rear end portion moving means, a motor for driving the twist shaft 24 of the twisting means, etc. is encased within the case, the microcomputer being automatically operated in accordance with a present program by operating the trigger switch 3. While in the present embodiment, a battery as a driving power supply is encased within a battery receiving section 4 of the body case for the convenience of portable use, it is to be noted of course that the apparatus may be connected to an external power supply.

The tying method for the article to be tied by way of the tying apparatus according to the present embodiment configured as described above will be explained with reference to FIGS. 1 to 5.

The encompassing guides 18 and 19 in their open state are positioned over the outer peripheral portion of the article to be tied (a), and after this the encompassing guides 18 and 19 are closed to retain the tying apparatus at the tying position as shown in FIG. 1. In this state, the drive roller 12 of the tying material feed means 6 is rotated by pressing the trigger switch 3 to start the feeding of the tying material. The control of the mount of feed of the tying material is effected by detecting a position of the substantially U-shaped extreme end portion of the tying material by a sensor.

The extreme end of the tying material w drawn out of the wound bobbin B by the tying material feed means 6 comes into engagement with the engaging portion 16 of the rotational member 16, as shown in FIGS. 3(*a*), 3(*b*) and FIGS. 4(*b*) to 4(*e*), whereby the rotational member 16 is pressed by the tying material and rotated inwardly. As a result, the end portion of the tying material w is retained at a predetermined position, and therefore the tying material w fed out is gradually bent into a substantially U-shape to form the starting point of forming two strands.

In this state, the tying material w is further fed out whereby the tying material w reaches the guide 18 while being bent in its extreme end into a substantially U-shape. As shown in FIG. 5, an external strand (b) is at least partly restrained by the encompassing guides 18 and 19 through a substantially U-shaped bent portion (c) and moved along the guide surface of the bottom thereof whereas an internal strand (d) is positioned inwardly from the opening of the encompassing guides, at least a part of which comes into direct contact with the article to be tied (a) and moves forward while being guided thereby. As a result, the state as indicated by FIG. 5(*d*) results via the statesas indicated by FIGS. 5(*a*) to 5(*c*) so that the tying material in the state of two strands is bent and guided to the outer periphery of the article to be tied (a) to form a large substantially U-shaped end portion (c). At the time of assuming the state of (d), the feeding of the tying material stops.

Subsequently, as shown in FIG. 3(*d*), the twist shaft 24 is rotated so that the hook 25 comes into engagement with the substantially U-shaped end portion (c) of the tying material and the drive roller 12 of the tying material feed means is reversely rotated to reversely pull the tying material whereby the tying material is moved out of the guide surface into engagement with the article to be tied (a) to assume a tensioned state. By this fact, even if the size of the article to be tied is varied, the article bound by a tying material at a minimum as required. In this case, the hook 25 is not necessarily brought into engagement with the substantially U-shaped extreme end portion (c) of the tying material but the drive roller 12 can be reversely rotated to pull out the tying material from the guide encompassing surface. Preferably, when the drive roller is reversely rotated, the bobbin is also reversely rotated so as to wind the loosened tying material.

Thereafter, the cutting means 7 cuts the length, forming a rear end portion of the tying material, in which state the twisting means rotates whereby the two strands which have been twisted from the substantially U-shaped end portion are formed into a single twisted strand as shown in FIG. 3(*e*). Thereby the two strands can be evenly bound without being separated at the time of tying. Therefore, no looseness occurs in the strands after the tying, and the strength of the tying material is enhanced to provide a firmer tying. However, this step is not always necessary but can be omitted.

When the two strands are twisted predetermined times, the moving lever 21 is rotated to press down the rear end portion of the tying material till it assumes a portion within a rotational locus of the hook 25. Thereby, the rear end portion of the tying material is also released from the rotational member 16 and positioned within the rotational locus of the hook. In this state, the hook 25 is rotated whereby the rear end portion of the tying material comes into engagement with the hook 25 and rotates along with the hook. As a result, the substantially U-shaped end portion (c) is twisted around the rear end portion (e) to effect the tying of the article to be tied.

In this twisting, the substantially U-shaped end portion is first twisted around the rear end portion, but other ends are soon twisted together. Since the hook 25 is in engagement with the U-shaped end, the twisting advances from the hook side toward the article to be tied (a), and the twisting can be advanced simply to take up a clearance in the tying portion of the article to be tied (a), to provide a firm tying.

At that time, the tying material undergoes a great rupturing force as the tying force increases. However, if a torque limiter is connected to the twist shaft 24 and when detecting a load in excess of a given level, the rotation of the twist shaft is stopped, the tying can be done with the strongest tying force without rupturing the tying material.

Upon completion of tying, the encompassing guides 18 and 19 are opened to remove them from the peripheral portion of the article to be tied (a). At the time, the hook can be reversely rotated to easily disengage the hook from the substantially U-shaped end portion (c) of the tying material, thus enabling the prompt shifting to the next step of operation. Further, the hook is further reversely rotated after the hook has been disengaged from the substantially U-shaped end portion of the tying material, whereby the twisted end of the tying material in the state projected outwardly from the article to be tied can be bent toward the surface of the article to be tied.

While in the above-described embodiment, the wound bobbin B has been held on the body case 1, it is to be noted that the wound bobbin is not necessarily held on the case but the wound bobbin can be placed at a position separately from the tying position and the tying material may be drawn out of such position.

FIGS. 6 and 7 show a further embodiment of the tying material bending means. Tying material bending means 50 shown in FIG. 6 has an engaging portion 51 comprised of a clamp with which the tying material engages, as shown in FIG. 6(*a*), the clamp being rotatably mounted on a rotational lever 52 by means of an actuator 53, the rotational lever being rotatably mounted on a machine frame by an actuator 54 such as a solenoid. In the drawing, reference numeral 55 designates an actuator for operating the clamp.

As shown in FIGS. (*b*) to 6(*d*), the tying material bending means according to the present embodiment configured as described above camps a part of the tying material w to be fed from the tying material feed means, in which state the rotational lever 52 and the engaging portion 51 are rotated by the actuator 54 and the actuator 53, respectively, to thereby bend a part of the tying material w to form a substantially U-shaped end portion.

While in the present embodiment, the engaging portion 51 is formed from a clamp, but it is not necessarily a clamp but a hole or a groove, through which the tying material passes, may be employed. In this case, it is contemplated that the tying material is fed out whereby the tying material held by the engaging portion somewhat slips against frictional force. However, if the holding position is sufficiently distanced from the front end of the tying material and the slip speed on the holding side is slower than the speed on the feed side, it is possible to guide the tying material around the article to be tied while forming a substantially U-shaped bended portion at the end thereof. Accordingly, it should be understood that the present invention is not always limited to the case where the tying material is held at a predetermined position but includes the case where the engaged part of the tying material is moved while undergoing a resistance. It is also possible that the tying material w bent once is reversely driven by the roller 49 or the like, as shown in FIG. 6(*e*), is delivered from at least one side at a speed faster or slower than that of the tying material feed means, and is guided around the article to be tied while forming a substantially U-shaped bent portion in the tying material.

In tying material bending means 56 shown in FIG. 7, an engaging portion 57 having an engaging groove or an engaging hole is held by an actuator 58 such as a solenoid or a cylinder so as to move in or out of path of the tying material w delivered from the tying material feed means. According to the present embodiment, when the tying material w delivered from the tying material feed means comes into engagement with the engaging portion 57 of the tying material bending means as shown in FIG. 7(*a*), the engaging portion 57 is withdrawn (moved downward in the figure) from the moving path to thereby bend the tying material as shown in FIGS. 7 (*b*) and 7(*c*). When the tying material is further fed, the tying material w advances while being bent into a substantially U-shape as indicated in FIG. 7(*d*).

On the other hand, the encompassing guides of the encompassing and guiding means can be variously changed in their shape and construction.

FIG. 8 shows another embodiment of the encompassing and guiding means. In the encompassing and guiding means 35 according to this embodiment, a rotatable roller 38 is suitably arranged in the guide surfaces of encompassing guides 36 and 37 to thereby reduce friction between the tying material and the guide surface so that the tying material can be smoothly guided to the peripheral portion of an article to be tied while forming two strands. The guide is preferred at least that the inside be opened while the outside is provided with a guide surface. However, it is preferable that a guide side plate is provided, as shown in FIG. 9 and FIG. 2, in order to prevent the tying material from being deviated laterally the side guide plate having suitable sectional shapes such as being convergent toward the inside as shown in FIG. 9(*a*), being divergent as shown in FIG. 9(*b*), or being a square gutter or a circular gutter.

The encompassing guides 36 and 37 will suffice to have a shape for encompassing an article to be tied as a whole, including suitable shapes such as a curve or a polygonal shape, or a combination of a curve and a straight line. Further, the encompassing guides 36 and 37 are not necessarily continuous but may be discontinuous such as the provision of a partial cut portion or being formed by a train of rollers.

FIG. 10 shows still another embodiment of the encompassing and guiding means. In the encompassing and guiding means 40 according to the present embodiment, encompassing guides 41 and 42 are formed to be twisted. The guide 41 close to the tying material feed means receives a tying material being fed while being formed with a U-shaped end portion horizontally, and gradually changes the direction of the U-shaped end portion from the horizontal plane to the longitudinal direction while guiding the tying material in a curved fashion. At that time, the U-shaped length of tying material is, at the outset, in which two strands are along the article to be tied, at least partly, successively changed in direction, and as a result, a part of the tying strand comes into direct contact with the article to be tied, and when reaching the end of the guide 42, the same state as the case of the previous embodiment results. Though not shown, alternatively, the encompassing guides 41 and 42 may be formed to be twisted so as to gradually change the tying material from the longitudinal direction to the horizontal plane conversely to the embodiment shown in FIG. 10.

Figure 11:
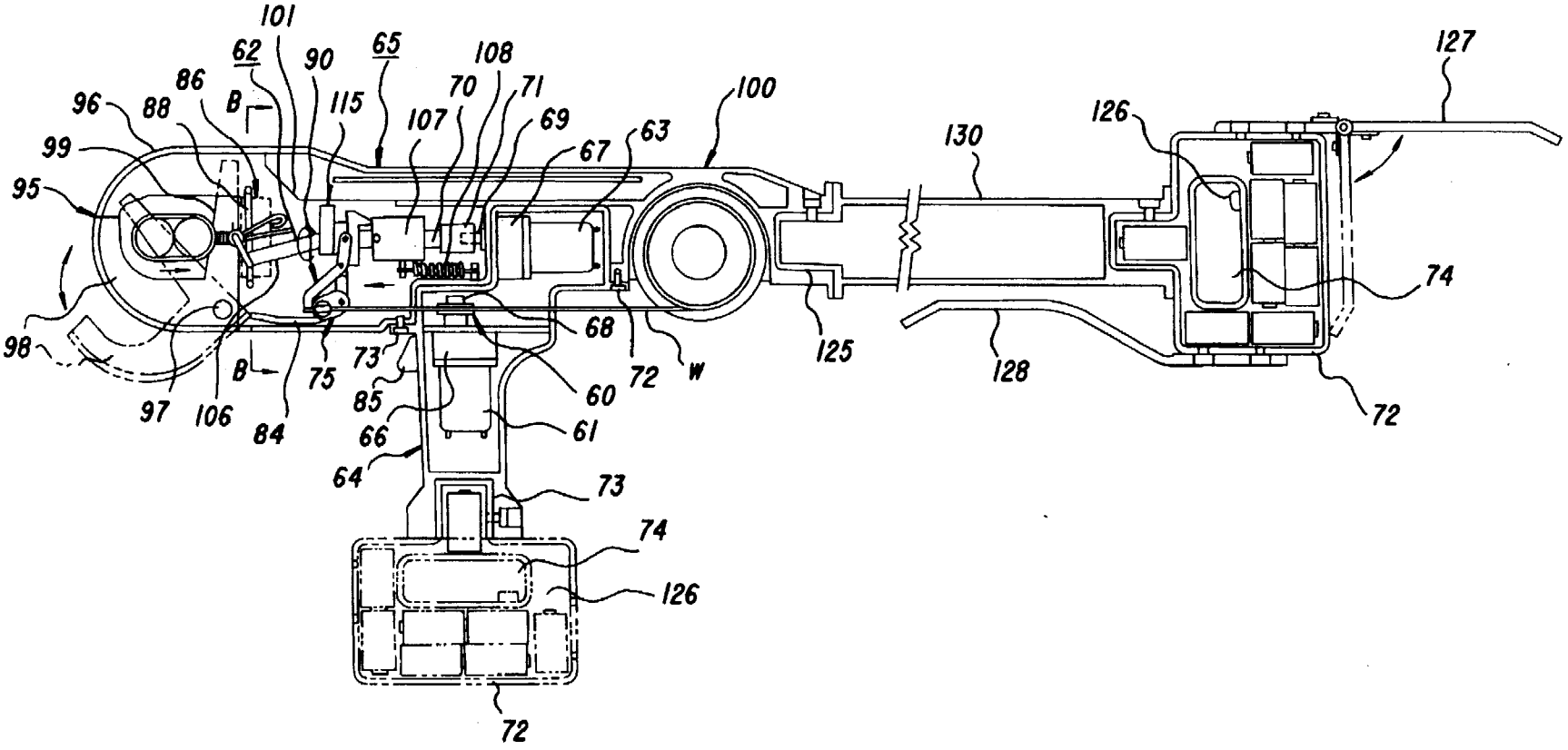
FIG. 11 is a schematic side view with a part of a case cutaway showing a further embodiment of the tying apparatus in accordance with the present invention.
Figure 12F:
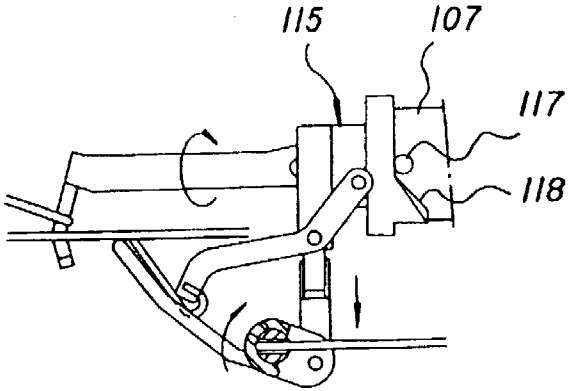
FIGS. 12(*a*) to 12(*h*) are partly sectional views and side views showing the operating state of the main parts in the tying steps.
Figure 12E:
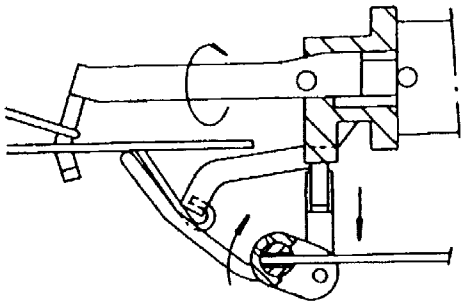
Figure 12H:
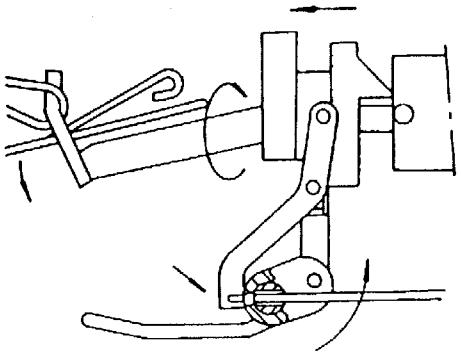
Figure 12G:
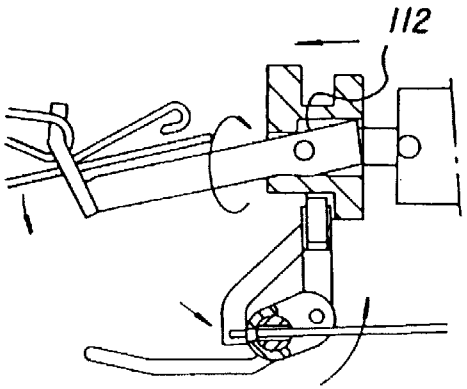
Figure 13A:
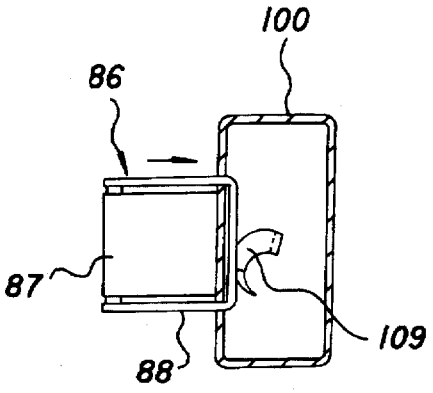
FIGS. 13(*a*) to 13(*c*) illustrate the operation of a bending member as viewed from B—B section of FIG. 11 showing the operating state of the bending member for a twisted end.
Figure 13B:
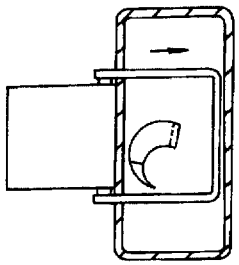
Figure 13C:
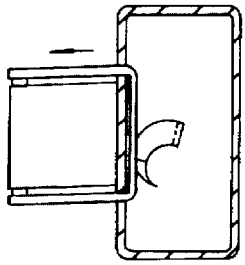

FIGS. 11 to 13 show another embodiment of the tying apparatus according to the present invention.

In the present embodiment, tying material feed means 60, a tying material feed motor 61 and a main motor 63 for rotationally driving twisting means 62 are encased within a motor case 64, a part of the motor case also serving as a handle, which is detachably mounted on a tying apparatus body 65, thus when a motor becomes worn, it can be replaced with a new motor.

More specifically, as shown in FIG. 11, the tying material feed motor 61 and the main motor 63 are arranged substantially at right angles to each other within the motor case 64, the respective motors being assembled integral with reduction gears 66 and 67. A tying material drive and feed roller is secured to an output shaft 68 of the tying material feed motor 61 so that the tying material drive and feed roller is rotationally driven so that the tying material is drawn out of the tying material bobbin B through a rotative frictional force by the tying material drive and feed roller and a tying material driven and feed roller not shown, and the tying material is caused to pass through the motor case and is delivered. An output shaft 69 of the main motor 63 is protruded from the motor case 64 to transmit a turning force to a spindle 70 as twisting means through an end of the spindle 70 and a suitable coupling 71 such as a sleeve couplining. Rerence numerals 72 and 73 designate screws for detachably screwing the motor case to the tying apparatus body, these screws being provided in suitable number.

Further, the motor case 64 is formed at the end thereof with a fitting depression 73 so that a battery case 72 can be detachably mounted, as indicated by the dotted line in FIG. 11. By mounting the battery case on the end of the handle, the weight is well balanced during operation and the tying operation can be accomplished easily. There is formed a knob hole 74 so that not only the battery case 72 can merely receive a battery but also it can be used as a knob when the battery case is connected to the rear end portion of the tying apparatus body, as indicated by the solid line in FIG. 11. The battery case is further provided with a trigger switch 126 so that when the battery case is mounted at the rear end portion of the body case the tying operation can be carried out while holding the battery case.

Next, the tying apparatus body 65 will be further described in detail.

Cutting means 75 is composed of a cutter comprising a combination of a columnar fixed blade 77 formed with through-hole on the fixed side through which the tying material w passes and a rotary blade 79 having a through-hole 78 on the rotational side through which the tying material, having passed through the through-hole on the fixed side, passes, and being externally fired over the fixed blade for rotation about the fixed blade. A lever 80 is protruded from the end of the rotary blade, a cam roller bracket 82 is mounted on the end portion of the lever through a rotatable connecting pin 81, and a cam roller 83 in contact with a cutter operating cam surface 119 of a cam body which will be described later is provided at the end portion of the cam roller bracket.

Further, in the present embodiment, the rotary blade 79 is provided with a tying material moving lever 84 so that at the same time when the tying material is cut, the cut end is moved to a portion at which the cut end can be easily engaged with the hook of the twist shaft.

Tying material bending means 90 is composed of a rotational member 92 having an engaging portion 91 such as a hole or a groove with which the end portion of the tying material engages. The rotational member is rotatably journalled in a fixed shaft 93 (FIG. 12(*b*)) so that the end of the tying material is engaged with the rotational member whereby the latter can be oscillated by the feed force of the tying material. A cam shift pin 94 is secured to the other end of the rotational member 92 so as to shift a cam body described later rightward in the figure.

Guiding means 95 is composed of a fixed guide 96 fixed in the end of a body case 100 and s closeable encompassing guide 98 rotatably journalled in a pin 97. The guiding means 95 is normally biased by a spring and is in an open state. The tying apparatus is pressed against an article to be tied through the opening whereby a tying article engaging piece 99 formed on the closeable encompassing guide 98 comes into engagement with the article to be tied to thereby close the closeable encompassing guide 98. In the figure, reference numeral 101 denotes a fixed guide piece secured to the body case.

The end of the fixed encompassing guide 96 is made narrow whereby in the case where an insulating sheet 186 is bound and secured to a pipe or duct 185 for air cooling and heating directly or through a keep netting 187 or the like, as shown in FIG. 16(*d*), when the fixed guide 96 is directly inserted into the insulating sheet and subsequently the closeable guide is closed, the tying operation can be accomplished easily.

Tying material twisting means 62 has a spindle 70 rotationally driven by the main motor, and a twist shaft 106 is oscillatably journaled in the end portion of the spindle 70. The spindle 70 is rotatably borne by a spindle bearing 107, and a base end thereof is connected to an output shaft of the main motor 63 through a coupling 71 to be axially displaceable and to transmit a rotational torque. A spring 108 is disposed between the spindle bearing 107 and the body case so that the spindle beating 107 is normally biased toward the main motor to retain the twist shaft at a predetermined position but, as the twisting advances so that the twist shaft is pulled toward the article to be tied, the spindle 70 can be displaced leftward in the figure against the tension of the spring 108.

The twist shaft 106 comprises a hook 109 adapted to hook a loop end of the tying material on the end portion to twist it and a shaft 110, the shaft 110 having an end oscillatably mounted on the end of the spindle 70 by means of a pin 111. The shaft 110 is formed at the base end with a control surface 112 for controlling the oscillation. A cam body 115 is formed at a diametrically central part with a through-hole which extends over a connecting portion between the spindle and the shaft, said through-hole constituting an inner cam surface for controlling the oscillation of the twist shaft. The cam body 115 is formed in its outer peripheral portion with a rotational member contact surface 116 in the form of a flange with which the end of the rotational member 92 contacts, and a return control cam surface 118 for displacing (returning) the cam body to its initial position by the contact thereof with a pin 117 projected from the outer peripheral portion of the spindle bearing 107 which is formed on the outer peripheral portion on the back side of the rotational member contact surface 116. The cam body 115 is further formed in its outer peripheral portion with a cutter operating cam surface 119 for operating the cutter.

The inner cam surface 120 is composed, as shown in FIG. 12*a*–12*h*, with a first groove portion $\mathbf{120}_1$ formed to have substantially the same width as that of the control surface 112 of the shaft 110 and a second groove portion $\mathbf{120}_2$ formed to be wider than the control surface. With this configuration, when the cam is in an initial position as shown in FIG. 12(*a*), the control surface 112 of the twist cam is at a position of the second groove portion $\mathbf{120}_2$ so that the shaft can be inclined through a predetermined angle about the pin 111 as shown. When the cam body moves rightward as shown in FIG. 12(*c*), the first groove portion 120 coincides with the control surface 112 of the shaft so that the shaft is locked on the spindle axis.

The tying apparatus according to the present embodiment is provided with tying end bending means 86 for bending the twisting end of the tying material from the state in which it protrudes outwardly from the article to be tied toward the surface of the article to be tied after the hook has been disengaged from the substantially U-shaped end portion of the tying material after tying. The bending means 86 is provided with a pressing and bending member 88 capable of being driven to be protruded so as to traverse a tying material-end protruding position after the completion of tying from the side wall, by means of the actuator 87 provided on the side wall of the body case 100, as shown in FIGS. 11 and 13. On the end opposite the guiding means 95 of the tying apparatus 65 is formed a fitting depression 125 adapted to fit and hold the battery case 72 or a relay adaptor 130. The battery case 72 is moved from the motor case and connected to the depression 125 whereby the tying operation for tying articles at a low or high position can be carried out easily by holding the battery case. In this case, electric wiring from a trigger switch 126 provided on the battery case 72 is connected to a control circuit within the body case by an electric wiring connector, and the tying apparatus can be driven by operating the trigger switch 126. At that time, in order to overcome trouble such that the battery case is simultaneously connected to both the motor case and the end opposite the tying apparatus body, in the case where the battery case is connected to either one of them, the other battery case connecting portion is automatically cut off from connection. The trigger switch 126 provided on the battery case can be provided at a suitable position such as within the knob or in the outer peripheral corner of the battery case, as shown in FIG. 11.

Further, in the present embodiment, as shown in FIG. 11, a first shoulder receiving plate 127 is foldably or removably mounted at the rear of the battery case 72. At the time of tying operation for the wall surfaces or the like, the shoulder receiving plate is placed on the shoulder, the motor case 64 is held by one hand, and the trigger 85 is operated as in shooting a rifle to effect the tying operation. Then, the tying apparatus feels light weighted and the tying can be carried out more easily. Further, when a second shoulder receiving plate 128 is provided, so as to extend in the opposite direction, on the side opposite the first mentioned shoulder receiving plate 127 on the battery ease 72, the operation with the apparatus placed on the shoulder can be accomplished even in a narrow space, and one can move with the tying apparatus placed on the shoulder. Alternatively, the shoulder receiving plate 127 is not placed on the shoulder but for example, a ring is hung from the shoulder, and the shoulder receiving plate is supported on the ring. Thus, the tying operation in the state where the tying apparatus is put in the side of chest can be also carried out.

When the battery case is mounted on the end of the motor case to effect the tying operation, as shown by the dotted line in FIG. 11, the shoulder receiving plate is removed or folded so as to keep out of the way.

The tying method for the article to be tied by the tying apparatus according to the present embodiment configured as described above will be explained hereinbelow with reference to FIGS. 11 to 13 in connection with only parts different from the previous embodiment.

When in the state where the guide 95 is open as indicated by the imaginary line in FIG. 11, the article to be tied-engaging piece 99 is pressed against the outer peripheral portion of the article to be tied (a), the closeable encompassing guide 98 is rotated and closed and the article to be tied is positioned at the inner peripheral portion of the encompassing guide as indicated by the solid line FIG. 11. In this state, the trigger switch 85 or 126 is pressed whereby the tying material feed motor 61 is driven so that the tying material feed roller rotates to start the feeding of the tying material w. In this state, the cam body 115 assumes a position on the twist shaft side, and the shaft assumes a position inclined with respect to the spindle 70. The tying material w delivered from the wound bobbin B passes through the fixed blade and the rotary blade of the cutting means by a suitable guide mechanism not shown, and the end thereof comes into engagement with the engaging portion 91 of the rotational member to push the rotational member by the feed force thereof (FIG. 12(*a*) and 12(*b*)). Thereby, the rotational member 92 rotates clockwise in the figure about the pin 93, and the cam shaft pin 94 comes into engagement with the rotational member contact surface 116 of the cam body to displace the cam body rightward from the state shown in FIG. 12(*a*). As a result, the first groove portion $\mathbf{120}_1$ of the inner cam comes into close contact with the control surface of the shaft to lock the shaft to the state which substantially coincides with the axis of the spindle 70 as shown in FIG. 12(*c*).

On the other hand, the end of the tying material w comes into engagement with the rotational member to prevent the end from moving and is maintained at a predetermined position. Therefore, the tying material w to be delivered reaches the guiding means 95 while the end being bent into a substantially U-shape and is bent and guided to the outer periphery of the tying portion of the article to be tied (a) in the form of two strands, whereby a large loop is formed at the end, which is detected by a sensor to stop the feeding.

Subsequently, the main motor 63 is rotated and driven whereby the twist shaft 106 rotates and the hook 109 thereof comes into engagement with the loop of the tying material (FIG. 12(*e*)). At this time, the tying material feed motor is reversely rotated to pull the tying material reversely whereby the tying material is completely removed from the guide surface of the guide and comes into engagement with the article to be tied (a) to assume a tensioned state. When the main motor is further rotated from the aforesaid state, the cutter operating cam surface 119 of the cam body 115 comes into contact with the cam roller 83 to press down the cam roller bracket 82 and rotate the rotary blade 79. As a result, the tying material is cut and the tying material moving lever 8e provided integral with the rotary blade also rotates about the fixed blade so that the cut end of the tying material and the end in engagement with the engaging portion of the rotational member are pushed up in the direction of the shaft (FIG. 12(*e*) and 12(*f*)). When the main motor further rotates from that state, the return control cam surface 118 of the cam body 115 comes into contact with the pin 117 projected from the outer peripheral portion of the spindle bearing 107 (the state immediately before starting the contact is shown in FIG. 12(*f*)) whereby the cam body is pressed leftward and returned to its initial position. As a result, the engagement between the first groove portion $\mathbf{120}_1$ of the inner cam surface and the control surface 112 of the twist shaft is released so that the twist shaft can be inclined to the state shown in FIG. 12(*g*). In this inclined state, the engaging portion between the hook 109 of the twist shaft and the tying material w assumes a position on the substantially diametrically central part of rotation of the spindle.

Further, since in the present embodiment, the spindle bearing 107 is provided to be displaceable against the tension of the spring 108, when the tension is exerted on the twist shaft as the twisting advances, the twist shaft 106 is gradually displaced toward the article to be tied as shown in FIG. 11. Accordingly, as shown in FIG. 11, the twisting can be advanced till a clearance with respect to the article to be tied (a) disappears, and the article to be tied can be firmly fastened. Thus, the conventional drawback can be overcome.

Upon completion of twisting, the main motor is reversed to reverse the twist shaft 106, whereby the engagement between the hook 109 of the twist shaft and the tying material is simply released, and the state returns to that shown in FIG. 12(*a*), completing the tying. Subsequently, as shown in FIGS. 13(*a*) to 13(*c*), the actuator 87 of the tying end bending means 86 is driven so that the bending member 88 is momentarily protruded into the body case to press and bend the tying end 190 of the tying material w, from the base end thereof, from the position shown by the broken line in FIG. 16(*a*) to the surface of the article as indicated by the solid line. Thereby, it is possible to prevent the tying end from being protruded, to keep it out of the way. In case of tying reinforcements, it is possible to prevent poor work such that the tying end protrudes from the concrete surface. When, after completion of tying, the tying apparatus is pulled away, the closeable encompassing guide 98 is opened to remove it from the peripheral portion of the article to be tied (a), and the operation can be promptly shifted to the succeeding mode of operation.

Figure 14:
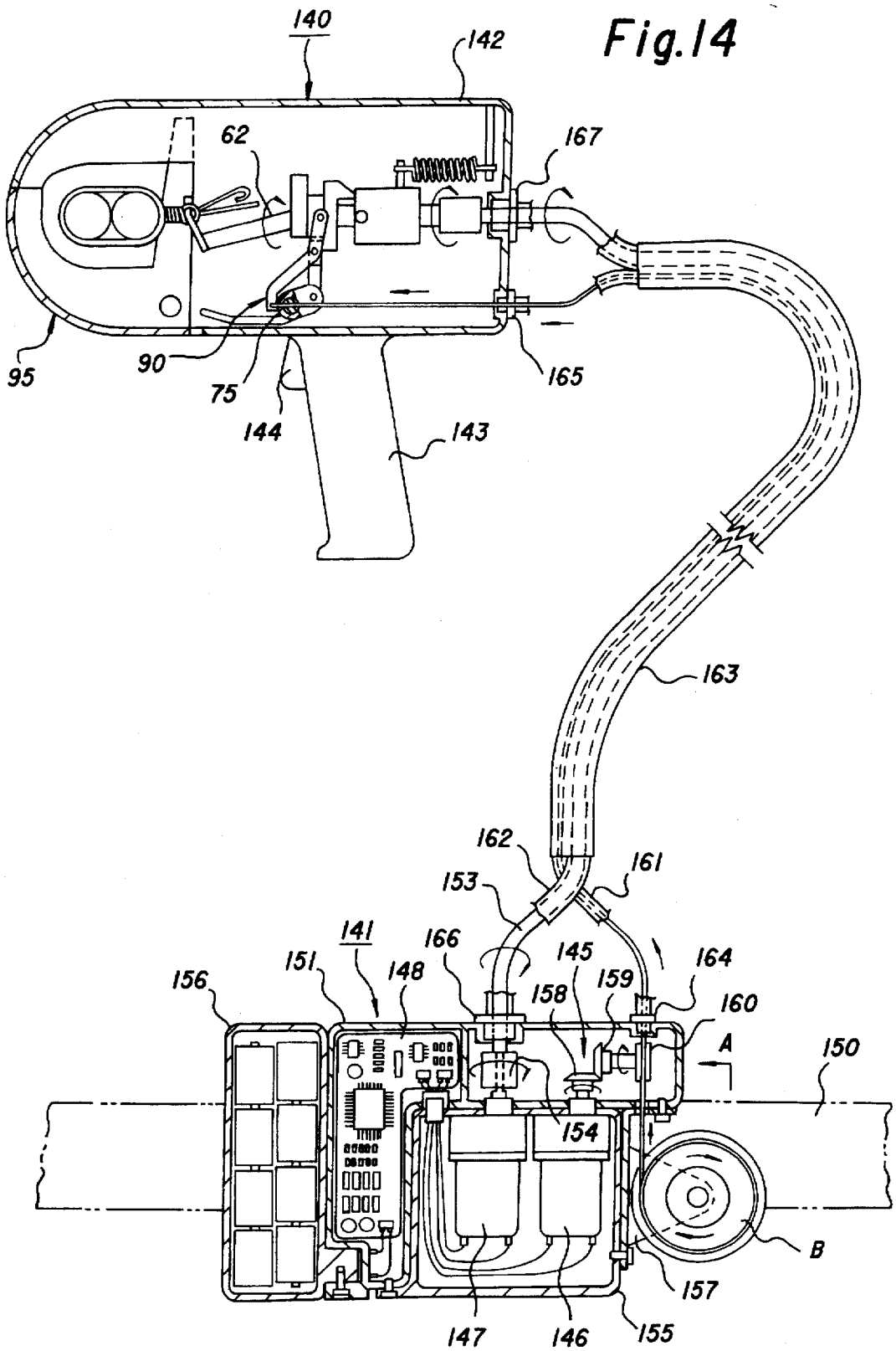
FIG. 14 is a schematic side view with a part of a case cutaway showing still another embodiment of the tying apparatus in accordance with the present invention.
Figure 16A:
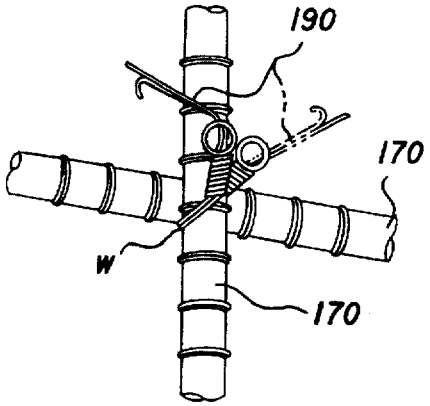
FIGS. 16 (*a*), 16(*b*), 16(*c*), 16(*d*) and 16(*e*) show the tying modes of an article to be tied according to the tying apparatus of the present invention, 16(*a*) showing the tying of reinforcement, 16(*b*) showing a bar-like article, 16(*c*) showing a mouth of a bag, 16(*d*) and 16(*e*) showing the tying and securing state of an insulating sheet of a duct.
Figure 16B:
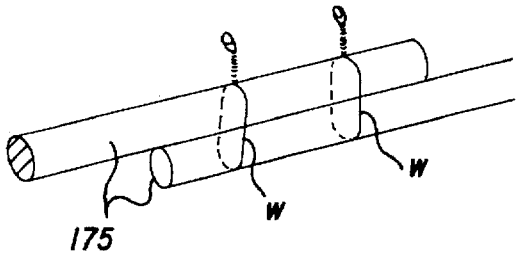
Figure 16C:
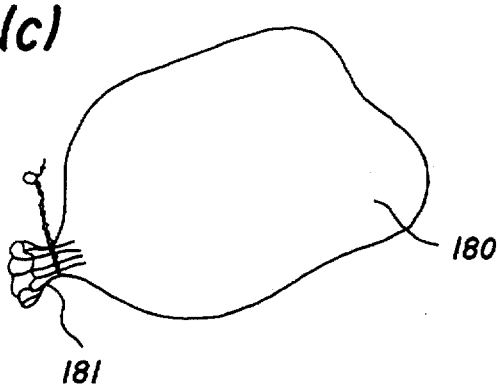
Figure 16D:
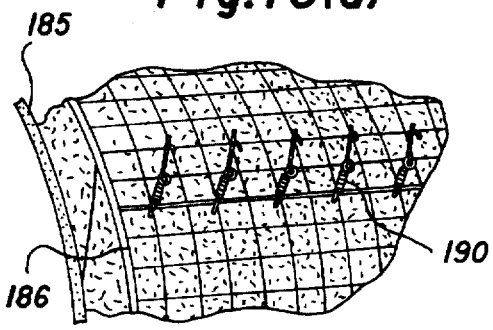
Figure 16E:
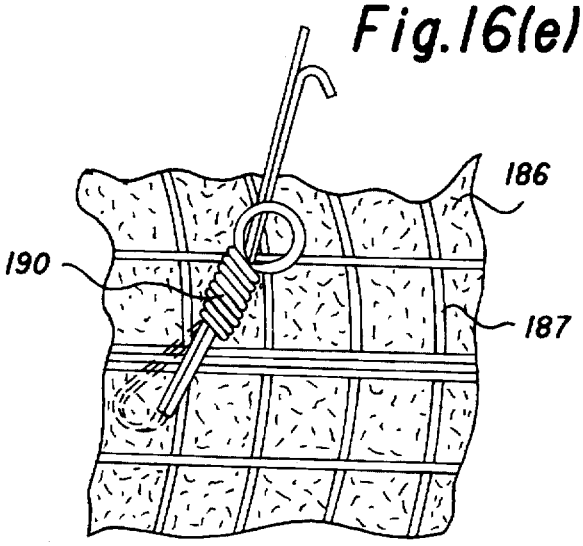

FIG. 14 shows still another embodiment of the tying apparatus according to the present invention.

In the present embodiment, an improvement over the previous embodiment is made such that the driving section and the tying material supply section are separated from the tying apparatus body in order to miniaturize the size and reduce the weight of the tying apparatus body.

More specifically the tying apparatus according to the present embodiment is composed of a tying apparatus body 140 formed to be a holding type in which an operator can hold the apparatus by one hand to perform the tying operation, and a drive and feed unit 141 in which a tying material to be supplied to the tying apparatus body and a drive motor are separated from the tying apparatus body so that the apparatus can be held on a belt of an operator.

The tying mechanism of the tying apparatus body 140 is substantially similar to that of the previous embodiment. Therefore, similar members are indicated by the same reference numerals as those used in the previous embodiment, detail description of which is omitted here.

The tying apparatus body 140 has cutting means 75, tying material bending means 90, guiding means 95, and twisting means, said respective means are mounted on a body case 142 so that a handle 143 formed on the body case is held, and a trigger switch 144 is pressed to actuate the apparatus. Although not shown in FIG. 14, the tying bending means may be provided as shown in FIG. 11 of the previous embodiment.

The drive and feed unit 141 has a tying material bobbin B, tying material feed means 145 for feeding the tying material from the tying material bobbin to the tying apparatus body, a tying material feed motor 146 for driving the tying material feed means, a main motor 147 for driving the twisting means 62, a drive and control circuit 148 comprised of a microcomputer, and a battery case 156. The tying material feed means 145, a shaft coupling 154 for transmitting a rotating force of the main motor to a flexible shaft 153, and the drive and control circuit 148 are received and arranged in a unit case 151. The tying material feed motor 146 and the main motor 147 are received in a motor case 155 of a cartridge type detachably mounted on the unit case 151 so that when a motor becomes worn, it can be freely replaced with a new one. While in FIG. 14, the motors 146 and 147 are integrally received in the case 155, it is to be noted that these motors may be received in separate cases, respectively.

The battery case 156 for receiving a battery is detachably mounted on the unit case 151 by suitable means such as screws. The wound bobbin B for the tying material is supported on the drive and wire feed unit case 151 through a wound bobbin supporting bracket 157. The drive and wire feed unit case 151, the motor case 155 and the battery case 156 are integrally assembled, which can be worn on the belt 150 or the like.

An output shaft of the tying material feed motor 146 is protruded into the unit case, to which end is secured a gear 158, which gear 158 is meshed with a gear 159 provided on a shaft of a tying material feed and drive roller 160 of the tying material feed means to rotate and drive a tying material feed and drive roller 160. The tying material w is drawn out of the tying material bobbin B and delivered with the aid of the frictional force between the tying material feed and roller and drive roller 160 and a tying material driven feed roller not shown. The tying material w having passed through the drive and feed unit case 151 passes through a flexible tying material guide pipe 161 communicated between the drive and feed unit case 151 and the tying apparatus body 142 and is supplied to the tying apparatus body 161.

An output shaft of the main motor 147 is protruded into the drive and feed unit case and can be detachably mounted on a shaft coupling 154 provided within the drive and feed unit case to transmit a rotating force through a shaft coupling 154 to a flexible shaft 153 which is protruded into the drive and feed unit case and detachably mounted on the shaft coupling 154. The flexible shaft 153 is rotatably inserted into a flexible flexible-shaft guide pipe 162 provided between the drive and feed unit case 151 and the tying apparatus body case 142. The tying material guide pipe 161 and the flexible guide pipe 162 extend together into a large diameter flexible pipe 163 for easy handling. In the figure, reference numerals 164 and 165 designate a drive and feed unit case provided on both ends of the tying material guide pipe and a connecting connector detachably provided on the tying apparatus body case 142, respectively. Reference numerals 166 and 167 designate connectors for flexible shaft guide pipes, respectively. Accordingly, the tying material guide pipe 161, the flexible shaft 153 and the flexible shaft guide pipe 162 can be simply removed. The tying apparatus body, and the drive and feed unit can be received in separate vessels, respectively, for storage and transportation.

While in the present embodiment, the motor case and the battery case are separately provided and detachably provided on the drive and feed unit case, it is to be noted of course that the motor and or the battery may be received in the drive and feed unit case. Further, while in the present embodiment, a battery as a drive power supply is encased in the battery case for convenience of portable use, it is to be noted of course that the apparatus can be configured capable of being connected to an external power supply.

With respect to the configuration of the battery, a battery case is not always necessary but the battery can be directly mounted on the drive and feed unit case.

The tying apparatus according to the present embodiment has been constructed as described above. The drive and feed unit 141 is held on the waist or the shoulder by the belt 150, and the tying apparatus body 140 is held by one hand to effect the tying operation. Accordingly, the tying apparatus body held by the hand is a mere twisting mechanism section, which is therefore very light in weight as compared with the conventional portable tying machine. The operation can be performed easily even in the operation for a long period of time in factories or elsewhere In the above-described tying operation, the tying apparatus body 140 and the drive and feed unit 141 are separated from each other and positioned away from each other. However, since the tying material is caused to extend through the guide pipe, it is not bent small in the midst of guiding but can be well guided. Further, since the guide pipe for guiding the flexible shaft and the tying material passes through a single large-diameter flexible tube, both are not entangled and not in the way of operation. It is to be noted that both need not to extend through the large diameter flexible tube but both may be integrally wound by a tape or the like.

The tying apparatus according to the present invention is characterized in that the tying mechanism section, the drive source for driving the mechanism section and the tying material to be sent to the mechanism section can be formed in separate units and separately held. Needless to say, the tying mechanism is not limited to that described in the above-described embodiments, but the apparatus can be also applied to the conventional tying mechanism.

Figure 15:
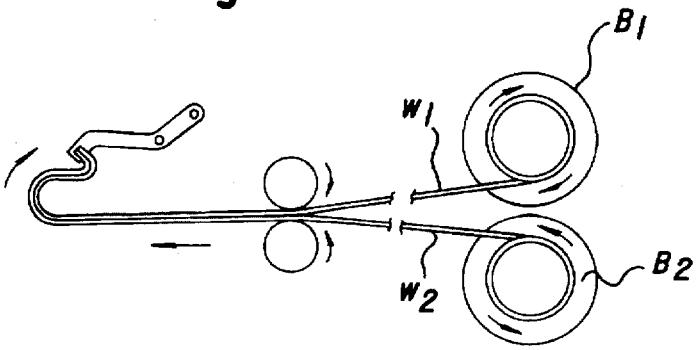
FIG. 15 is a partial schematic view of the tying step according to still another embodiment of the tying method and apparatus in accordance with the present invention.

Further, while in the above-described embodiments, a single strand of tying material is drawn out of a single wound bobbin, the tying material is then bent into two strands and the tying is made once by the two strands, it is to be noted that the present invention is not limited thereto but an arrangement may be made such that for example, as a part of the step is schematically shown in FIG. 15, two wound bobbins $B_1$ and $B_2$ are mounted on the drive and feed unit, two lengths of tying materials $w_1$ and $w_2$ are joined and simultaneously drawn out, and they are bent and bound as four strands, and in addition, a plurality of strands can be also used. By increasing the number of lengths of tying materials, the tying force can be further enhanced and a diameter of each tying material can be reduced, thus reducing a bending resistance, reducing the curvature of the guiding means and realizing the miniaturization.

INDUSTRIAL APPLICABILITY

As described above, the tying method and tying apparatus according to the present invention exhibit advantageous effects in tying and fixing reinforcements 170 in the operation of arrangement of reinforcements as shown in FIG. 16(*a*). However, articles to be tied are not limited to reinforcements but the present apparatus is also useful for tying of various articles, for example, such as articles to be tied such as bars 175 or pipes as shown in FIG. 16(*b*), a mouth 181 of a bag 180 as shown in FIG. 16(*c*), and a single article to be tied such as a heat insulating sheet in which a heat insulating sheet 186 or the like is wound around a pipe or duct 185 as shown in FIGS. 16(*d*) and 16(*e*). The present apparatus can be applied to the tying of various articles if they can be bound. Further, the present apparatus can be also utilized not only for a portable use in which an operator holds the apparatus during tying but also as a tying operating hand mounted on a robot arm.

We claim:

1. A method of tying articles, comprising the steps of: engaging and rotating an end portion of a tying material to form a starting point of the tying material being formed into a substantially U-shape for forming a pair of side-by-side strands of tying material; guiding the tying material around an article to be tied while bending a part of a continuous portion of the linear tying material into the substantially U-shape to form the pair of side-by-side strands of tying material by a feeding force by which the tying material is further fed from a side opposite to said starting point; cutting a rear end portion of said tying material from a continuous wire at a suitable time; and twisting a substantially U-shaped extreme end portion and a rear end portion on another side of said tying material together to band the article to be tied.

2. A method according to claim 1, wherein in said encompassing and guiding step, the tying material is guided while being bent in a substantially longitudinal direction, the outside of the bend having at least a part guided along a curved guide surface, the inside thereof having at least a part moved while directly contacting the article to be tied to form two strands.

3. A method according to claim 1, wherein in said guiding step, the tying material is bent in a substantially widthwise direction to form a bend, wherein opposite sides of the bend have at least a part moved while being guided along said curved guide surface to form two strands.

4. A method according to claim 1, 2 or 3, wherein after said encompassing and guiding step, the rear end portion of the tying material is moved toward a diametrically central part of rotation of the twisting means.

5. A method according to claim 1, 2 or 3, wherein after said encompassing and guiding step, a tying material feed motor is reversely rotated to pull the tying material in a reverse direction to thereby bring the tying material into engagement with the peripery of the article to be tied and stretched.

6. A method according to claim 1, 2 or 3, wherein in said twisting step, the twisting is effected such that an engaging point between a twist shaft for effecting the twisting and the tying material is displaced so that at the time of starting engagement, the engaging point is at a position deviated from a diametrically central part of rotational drive of the twist shaft, and as the twisting advances, the engaging point substantially coincides with the diametrically central part of rotational drive of the twist shaft.

7. An apparatus for tying articles, the apparatus comprising: tying material feed means (6, 60, 145) for delivering a continuous linear tying material; tying material bending means (8, 50, 56, 90) in engagement with a part of the tying material to be delivered from said tying material feed means; encompassing and guiding means (9, 35, 40, 95) for guiding the tying material around an article to be tied while bending into a substantially U-shape the tying material a part of which is engaged in said tying material bending means and is delivered; cutting means (7, 75) for cutting the tying material into a predetermined length; and twisting means (11, 62) for twisting both ends of the tying material together, wherein said tying material bending means comprises an engaging and rotating means for engaging and rotating an end portion of the tying material to form a starting point of the tying material being formed into the substantially U-shape.

8. An apparatus according to claim 7, wherein said tying material bending means comprises a rotational member (16, 52, 92) having an engaging portion (5, 51, 57, 91) with which an extreme end of the tying material engages and journalled to be rotated when the extreme end portion of the tying material delivered from said tying material feed means (6, 60, 145) engages said engaging portion and is delivered.

9. An apparatus according to claim 7, wherein said tying material bending means (56) has an engaging portion (57) with which a part of the tying material engages, said engaging portion being driven by an actuator (58).

10. An apparatus according to claim 7, 8 or 9, wherein said encompassing and guiding means comprises a closeable encompassing guide (98) closeably mounted on the extreme end of a body case and a fixed encompassing guide (96), said closeable encompassing guide (98) being formed with an article to be tied engaging piece (99) rotatably journalled in the body case (100) and located at a base end.

11. An apparatus claim 7, 8 or 9, comprising tying material moving means (10, 84) for moving the rear end portion of the tying material guided around the article to be tied toward the diametrically central part of said twisting means.

12. An apparatus according to claim 7, 8 or 9, wherein said tying material twisting means comprises a twist shaft (106) oscillatably journalled in an extreme end portion of a spindle (70) rotated and driven by twisting and driving means, and a twist shaft oscillation control means for controlling said twist shaft to a fixed state for fixing it so as to substantially coincide with a diametrically central part of the spindle (70) and an oscillatable state within a range of a predetermined angle.

13. An apparatus according to claim 12, wherein said twist shaft oscillation control means comprises a cam body (115) having a through-hole slidably externally fitted over a connecting portion between said twist shaft (106) and said spindle (70), said through-hole constituting an inner cam surface (120) for controlling said twist shaft (106) to a fixed state on the diametrically central part of rotation of the spindle and an oscillatable state within a range of a predetermined angle.

14. An apparatus according to claim 12, wherein said spindle (70) is urged to be axially displaceable.

15. An apparatus according to claim 7, 8, or 9, comprising tying end bending means (86) having a pressing and bending member (88) protruded and driven to a protruded position of an end of tying material after completion of tying to bend the twisted end of the tying material.

16. An apparatus according to claim 7, wherein said tying material feed means, said tying material bending means, said tying material encompassing and guiding means, said cutting means and said twisting means are installed in the body case (100) having a handle, and at least one of motors for rotating and driving said tying material feed means and said twisting means is received in a motor case (64) of a cartridge type detachably mounted on said body case.

17. An apparatus according to claim 16, wherein at least a part of said motor case (64) serves as a handle.

18. An apparatus according to claim 17, wherein said motor case (64) has a body case engaging portion detachably engaged with the body case (100) and a battery case engaging portion for receiving a battery for driving said motor on the opposite side, and a battery case can be detachably engaged with said battery case engaging portion.

19. An apparatus according to claim 18, wherein said body case (100) has a battery case engaging portion for allowing said battery case (72) detachably engage an end lengthwise opposite said encompassing and guiding means directly or through a relay adaptor (130), said battery case (72) having a trigger (126) for driving said motor and capable of being selectively engaged with said motor case (64) and said body case (100).

20. An apparatus according to claim 19, wherein a shoulder receiving plate (127) is provided in said battery case.

21. An apparatus for tying articles, comprising a tying apparatus body (140) having a tying mechanism selection device; and a drive and wire feed unit (141) having a motor for driving the tying mechanism of said tying apparatus body and tying material feed means for supplying a tying material to the tying apparatus body (140), wherein a motor output shaft of said drive and wire feed unit (141) and a drive shaft of the typing mechanism of said tying apparatus body (140) are connected by a flexible shaft (153) to transmit a driving force, wherein a continuous linear tying material is supplied from said drive and wire feed unit (141) to said tying apparatus body (140) for the automatic binding of an article, and wherein the tying mechanism selection of said tying body (140) comprises tying material bending means (8, 50, 56, 90) in engagement with and holding a part of a tying material (w) to be fed in a continuous linear fashion; encompassing and guiding means (9, 35, 40, 95) for guiding the tying material around an article to be tied while bending the tying material a part of which is engaged in said tying material bending means and delivered from at least one side into a substantially U-shape; cutting means (7, 75) for cutting said tying material into a predetermined length; and twisting means (11, 62) for twisting both ends of the tying material together.

22. An apparatus according to claim 21, wherein said drive and wire feed means (141) has a main motor (147) for driving said tying mechanism selection; a tying material feed motor (146) for driving said tying material feed means; a control circuit (148) for controlling said tying material feed motor (146) and said main motor (147); a battery case (156) for receiving a power supply battery; and a wound bobbin supporting bracket (157) for the tying material w.

23. An apparatus according to claim 21, wherein at least one of said main motor (147) and said tying material feed motor (146) is received in a motor case (155) and detachably mounted on a trait case (151).

* * * * *